United States Patent [19]

Aoki

[11] Patent Number: 4,707,114

[45] Date of Patent: Nov. 17, 1987

[54] METHOD OF AUTOMATICALLY ADJUSTING IMAGE DENSITY IN IMAGE FORMING DEVICE

[75] Inventor: Minoru Aoki, Kawasaki, Japan

[73] Assignee: Ricoh Company, Ltd., Tokyo, Japan

[21] Appl. No.: 927,107

[22] Filed: Nov. 5, 1986

[30] Foreign Application Priority Data

Nov. 13, 1985 [JP] Japan ..... 60-254220

[51] Int. Cl.[4] ..... G03G 15/00

[52] U.S. Cl. ..... 355/14 D; 355/14 E

[58] Field of Search ..... 355/3 DD, 14 D, 14 E, 355/14 R, 67–68

[56] References Cited

U.S. PATENT DOCUMENTS

| | | | |
|---|---|---|---|
| 4,200,391 | 4/1980 | Sakamoto et al. | 355/14 D |
| 4,372,674 | 2/1983 | Yukawa et al. | 355/14 D |
| 4,572,654 | 2/1986 | Murai et al. | 355/14 D |
| 4,618,248 | 10/1986 | Buchar | 355/14 E |
| 4,619,522 | 10/1986 | Imai | 355/14 D |
| 4,627,712 | 12/1986 | Usami | 355/14 E |

*Primary Examiner*—Peter S. Wong

*Attorney, Agent, or Firm*—Oblon, Fisher, Spivak, McClelland, & Maier

[57] ABSTRACT

An automatic image density adjusting method for an image forming device is disclosed which selects image density adequately in matching relation to any of various kinds of documents. There are selectively set up a first mode in which image density is sensed over a predetermined region of a document and, then, the operation directly enters into a copying cycle; and a second mode which occurs when the document density level sensed is different from a predetermined one and performs a different document density sensing operation. When density sensing which is performed on a density sensing region in the first mode is insufficient, the second mode is set up so that document density is sensed by prescanning an enlarged density sensing region so as to enter into a copying cycle after selecting a particular imaging condition. While ordinary documents are processed in the first mode to increase the copying rate, those documents which contain solid portions are processed in the second mode to provide images with adequate density which matches with the background density of such a document.

6 Claims, 12 Drawing Figures

Fig. 3
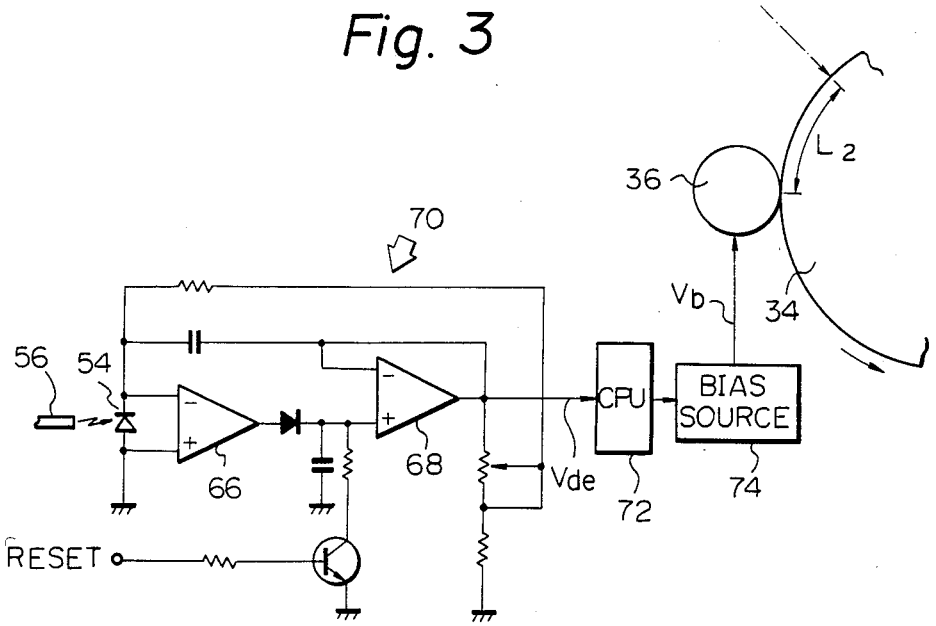
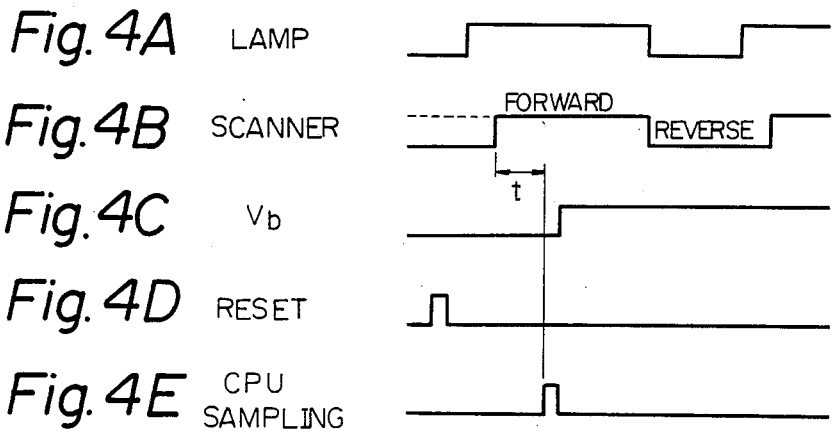

METHOD OF AUTOMATICALLY ADJUSTING IMAGE DENSITY IN IMAGE FORMING DEVICE

BACKGROUND OF THE INVENTION

The present invention relates to a method of automatically adjusting density in a copier and other image forming devices.

In a copier and other image forming devices, it is a common practice to sense the density of an original document in order to compensate the amount of exposing light and other factors. One approach to sense document density is loading a scanner with a density sensor so that the density of a document may be sensed by the sensor prior to usual slit exposure, as disclosed in Japanese Laid-Open Patent Publication (Kokai) No. 58-214144/1983. The scanner type scheme allows density to be adjusted automatically without resorting to prescanning, i.e. scanning which is effected before a document is actually scanned to form a latent image thereof. However, a problem with the density sensing system without prescanning is that due to a limitation on a sensing region the amount of information sensed is too small for image density to be optimized according to information on a document. The prescanning system, on the other hand, successfully provides density information over the entire length of a document and, therefore, promotes the ease of adjustment of image density. Nevertheless, such a system is inherently low in copying rate.

In light of the above, there has been proposed another approach which allows any desired sensing region to be selected manually in the event of image density sensing so that image density may be optimized, as disclosed in Japanese Laid-Open Patent Publication (Kokai) No. 59-142573/1984. This type of scheme has a drawback that the manual operation is time- and labor-consuming. Another drawback is that because the basis for the selection of a sensing region is indefinite, the expected effect is not readily attainable when it comes to copiers which use plain papers and are used by many and unspecified persons.

SUMMARY OF THE INVENTION

It is therefore an object of the present invention to provide a method of automatically adjusting image density in an image forming device which sets up adequate image density matching with any of various kinds of original documents while enhancing rapid copying operations.

It is another object of the present invention to provide a generally improved method of automatically adjusting image density in an image forming device.

A method of automatically adjusting image density in an image forming device which controls an imaging condition on the basis of a density of a document of the present invention comprises the steps of, at a start of a copying operation, setting up a first mode in which a first document density is sensed by scanning a first predetermined region of the document and, then, the copying operation is continued while controlling the imaging condition based on the first document density, and, if the first document density sensed lies in a predetermined range of density levels, executing the first mode directly, and, if the first document density does not lie in the predetermined range of density levels, replacing the first mode with a second mode in which a second predetermined region of the document is scanned to produce a second document density and, then, performing a copying operation while controlling the imaging condition based on the second document density.

The above and other objects, features and advantages of the present invention will become more apparent from the following detailed description taken with the accompanying drawings.

BRIEF DESCRIPTION OF THE DRAWINGS

FIG. 3 is a circuit diagram representative of a control section which is installed in the system of FIG. 1;

FIGS. 4A to 4E are timing charts demonstrating the operation of the system of FIG. 1;

DESCRIPTION OF THE PREFERRED EMBODIMENT

Figure 1:
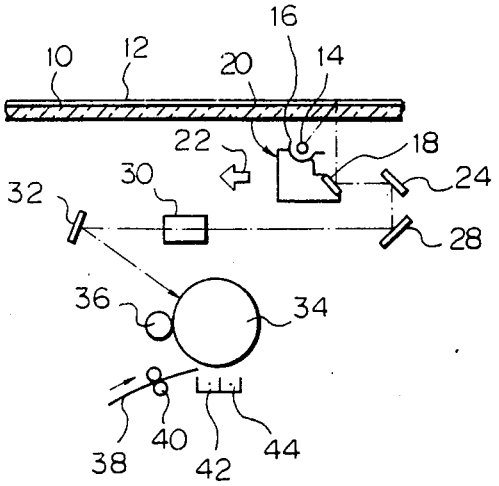
FIG. 1 is a schematic side elevation of a copying system to which a method of the present invention is applicable.

Referring to FIG. 1 of the drawings, a copier to which an automatic image density adjusting method of the present invention is applicable is shown. As shown, an original document 12 laid on a glass platen 10 is sequentially exposed imagewise in a direction indicated by an arrow 22 by a document illuminating unit, or scanner, 20 which is loaded with a lamp 14, a reflector 16, and a first mirror 18. A light image reflected from the document 12 is focused by a second mirror 24, a third mirror 28, a lens 30 and a fourth mirror 32 onto a photoconductive element 34 and, then, developed by a developing sleeve 36. A paper 38 is fed to the photoconductive element 34 at a predetermined timing by a registration roller 40, so that the image developed is transferred to the paper 38 by a transfer charger 42. Thereafter, the paper 38 is separated from the element 34 by a separation charger 44.

Figure 2:
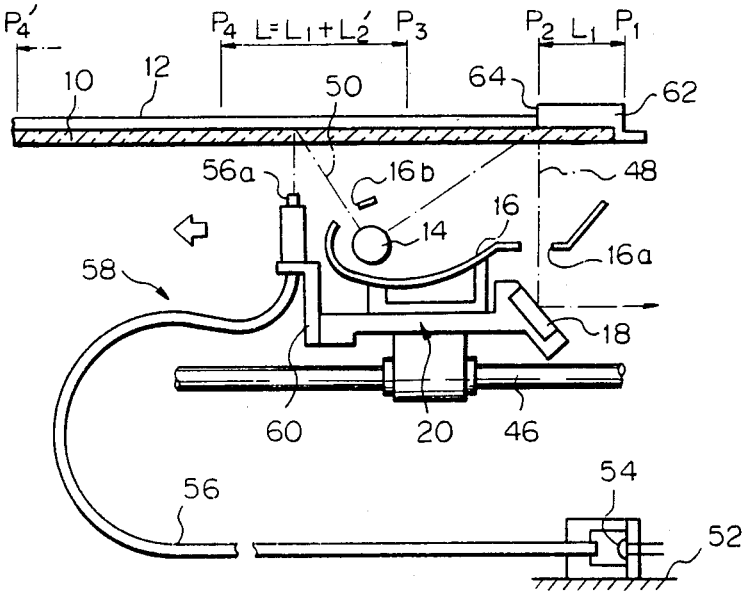
FIG. 2 is a sectional side elevation of a document scanning section which is included in the system of FIG. 1.

As shown in FIG. 2, the scanner 20 is movable in a reciprocating motion guided by a guide shaft 46. The reflector 16 is formed with an opening 16a through which imaging light 48 is passed toward the first mirror 18. In this particular embodiment, the lamp 14 also implements sensing light 50 adapted to sense the density of the document 12. The reflector 16 is formed with another opening **16*b* through which the sensing light 50 reaches the document 12 before the imaging light 48**.

A light-sensitive element 54 such as a photodiode is mounted on a stationary member 52 of a body of the copier. A flexible optical fiber 56 is provided at one end thereof with an inlet portion **56*a* to which light derived from the sensing light 50 and containing density information is incident from the document 12. The other end of the optical fiber 56 is located to face the light-sensitive element 54. The light-sensitive element 54 and optical fiber 56 constitute a density sensor as generally designated by the reference numeral 58. That is, a document image is transmitted to any desired position by the optical fiber 56, and the amount of light transmitted so is sensed by the light-sensitive element 54. Let the position of the density sensor 58 be represented by that of the inlet portion 56*a* of the optical fiber 56. A portion of the optical fiber 56 adjacent to the inlet portion 56 is fixed by a stationary angle 60 to the scanner 20. In FIG. 2, the reference numeral 62** designates a document reference plate which is located at a home position.

Next, positional relationships between the various structural elements will be described. FIG. 2 shows a condition wherein the scanner 20 has moved a short distance away from the home position to bring an imaging portion 64 into alignment with the leading end of the document 12. Assume that the imaging portion 64 of the scanner 20 is located at a position $P_1$ when the scanner 20 is at the home position and at a position $P_2$ in the condition of FIG. 2, and that the inlet portion 56*a* of the optical fiber 56 is located at a position $P_3$ when the scanner is at the home position and at a position $P_4$ when the leading end of a latent image is brought to the developing section. An arangement is made such that at the home position the imaging portion 64 is deviated from the document 12 by a distance $L_1$ so as not to face the document 12. The optical fiber 56, on the other hand, is arranged such that its inlet potion 56*a* precedes the imaging portion 64 by a distance between the positions $P_1$ and $P_3$ and, a home position of the scanner 20, faces the document 12 at the position $P_3$.

In the above construction, a copying operation is effected usually in a first mode as will be described. Basically, the first mode is such that the density of the document 12 is sensed by the sensing light 50 which scans he document 12 between the positions $P_3$ and $P_4$ and, based on the maximum value of the resultant detection signal (corresponding to the background of the document), a developing bias voltage is controlled, whereafter a copying cycle begins. Thus, the first mode does not rely on prescanning. First, while the scanner 20 is moved from the home position toward the position (current position) as shown in FIG. 2, the inlet portion 56*a* of the optical fiber 56 which faces the document 12 from the start scans the document 12. Specifically, light containing density information on the document 12 and derived from the sensing light 50 is introduced into the optical fiber 56 via the inlet portion 56*a*. This light is propagated through the optical fiber 56 to the light-sensitive element 54 to be photoelectrically converted thereby.

As shown in FIG. 3, the light-sensitive element 54 which is implemented with a photodiode in this particular embodiment is interconnected to a peak hold circuit 70 which includes, for example, two operational amplifiers (OP AMPs) 66 and 68. A photocurrent which flows through the light-sensitive element 54 is subjected to current-to-voltage conversion to become a detection signal or sensity signal $V_{de}$. It is to be noted that the element 54 is interconnected between the inverting and the non-inverting inputs of the OP AMP 66 and used with no voltage applied in order to eliminate dark current. The detection signal $V_{de}$ produced from the OP AMP 68 as stated is effectively used as a signal, i.e., density information which determines process conditions for copying cycles. It will be needless to mention that at the instant when the scanner 20 starts moving the lamp 14 has to have already been built up.

Subsequently, the scanner 20 is further moved to the left away from the current position as shown in FIG. 2. During this movement, too, the sensing light 50 which precedes the imaging light 48 continuously senses the density of the document 12. The leading end of a latent image which is formed sequentially on the photoconductive element 34 by the imaging light 48 is in due course brought to a developing station where the developing sleeve 36 is positioned. Just before this, a developing bias voltage associated with the detection signal $V_{de}$ is computed by a central processing unit (CPU) 72, which is provided with an analog-to-digital converter, and applied to the sleeve 36. For example, as regards the peak hold circuit 70 of FIG. 3, a maximum value between the positions $P_3$ an $P_4$ is detected and regarded as the density of the background of the document 12, and a bias voltage $V_b$ corresponding to the maximum value is applied to the developing sleeve 36.

Where the bias voltage $B_b$ is controlled as in the illustrative embodiment, the distance L between the current position $P_3$ and the position at which the leading end of a latent image reaches the developing station is converted into a distance on the document and, therefore, this distance L is varied when the magnification is increased or decreased. Assuming that the distance between an exposing portion and a developing portion on the photoconductive element 34 is $L_2$ as shown in FIG. 3, the scanning distance L of the density sensor 58 which can be used effectively for density adjustment may be expressed as:

$$L=L_1+L'_2=L_1+(L_2/m)$$

where m denotes an enlarging/reducing ratio which is equal to or greater than 0.5 and equal to or smaller than 2.

Referring to FIGS. 4A to 4E, the procedure described so far is shown in timing charts. It will be seen from the timing charts that the lamp 14 has been built up when the scanner 20 starts its scanning stroke. The period of time t is representative of a density sensing section which corresponds to the distance L ($=L_1+L'_2$) of FIG. 2.

As described above, in the first mode operation, the density sensor 58 faces the document from the start of a scanning stroke of the scanner 20 so as to sense the density and, therefore, a substantial density sensing region is ensured to enhance accurate density control. Means for implementing the first mode operation is very simple. While in an equal size copy mode the density control is effected by sensing image density in a certain particular area of the document 12, in a reduced or an enlarged size copy mode the sensing region is automatically changed depending on the ratio of magnification change so as to enhance desirable density control.

It is to be noted that the peak hold circuit 70 of FIG. 3 is provided with a function of applying a reset signal to a reset terminal in order to cancel a past record before sensing density.

While the bias voltage $B_b$ has been described as being controlled on the basis of sensed document density, the amount of exposing light which issues from the lamp 14 may be controlled in place of or in combination with the bias voltage $B_b$. When the amount of exposing light is to be controlled, it is necessary that the amount of light issuing from the lamp 14 be maintained constant between the home position and the current position of FIG. 2 and, then, be changed at the current position in response to an output of the document sensor 58 which has appeared till then. In this connection, in the case where the response of the lamp 14 is questionable, the density signai will be picked up and the amount of light issuing from the lamp 14 will be changed each at a position which is closer to the home position than the current position of FIG. 2.

The first mode operation as discussed above is the basic operation in accordance with this embodiment. So long as the density signal $V_{de}$ appearing between the positions $P_3$ and $P_4$ lies within a predetermined range, a copying cycle is repeated in the first mode. However, when the density signal is brought out of the predetermined range, the mode is switched from the first mode to a second mode which is different from the first mode as will be described.

Figure 5A:
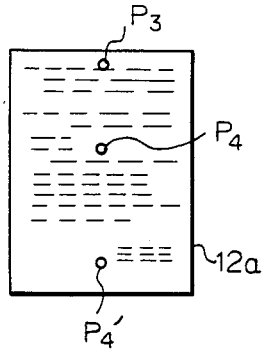
FIGS. 5A to 5C are plan views of various kinds of documents.
Figure 5B:
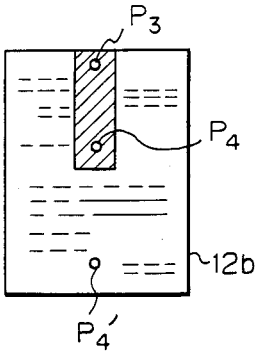
Figure 5C:
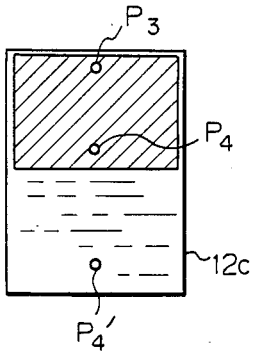
Figure 6:
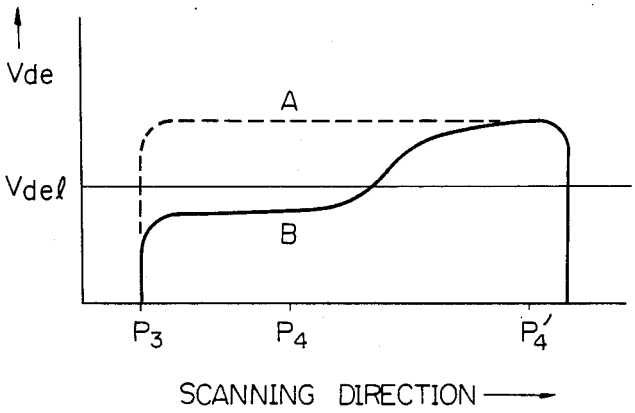
FIG. 6 is a plot showing a characteristic of a detection signal.

As shown in FIGS. 5A to 5C, assume three different kinds of documents 12*a*, 12*b* and 12*c*. As regards the document 12*a* of FIG. 5A on which ordinary alphanumeric characters and the like are printed, its background density is sensed between the positions $P_3$ and $P_4$ with the result that a detection signal $V_{de}$ such as represented by a curve A in FIG. 6 is produced. In FIG. 6, the curve A falls at the rightmost end since the lamp 14 is turned off after the completion of scanning which covers the length of the document 12*a* and the sensing circuit is reset. Generally, the background density of ordinary documents ranges substantially from OD 0.05 to 0.3.

When it comes to the document 12*b* or 12*c* which contains a solid portion as shown in FIG. 5B or 5C, what is sensed between the positions $P_3$ and $P_4$ is only the density of the solid portion, resulting in a detection signal $V_{de}$ such as represented by a curve B in FIG. 6. In this condition, should the developing bias $V_b$ be controlled by the signal $V_{de}$ as represented by the curve B and appearing when the inlet portion 56*a* of the optical fiber 56 has reached the position $P_4$, i.e., when the latent image on the element 34 has arrived at a position just before the sleeve 36, the resultant copy would have undesirably low density. The same holds true with a case wherein the amount of exposing light is controlled.

To eliminate the occurrence stated above, as shown in FIG. 6, a predetermined reference density signal level $V_{de\gamma}$ is set up. When the detection signal $V_{de}$ remains lower than the reference signal level $V_{de\gamma}$ throughout the section between the positions $P_3$ and $P_4$, it is decided that the background density of the document 12*b* or 12*c* has not been detected. Then, the mode is switched from the first to the second in which the density sensing region is extended to a position $P'_4$ so as to use even the signal $V_{de}$ which appears after the position $P_4$. In short, although the density sensing operation in the second mode is identical with that which occurs in the first mode, the sensing region in the second mode is wider than that in the first mode.

Whether to continue the operation in the first mode or to switch it to the second mode is decided by referencing the level of the detection signal $V_{de}$ at the instant when the inlet portion 56*a* of the optical fiber 56 has reached the position $P_4$ (when the amount of exposing light is controlled, a position closer to the position $P_3$ than the position $P_4$). In such a second mode, the enlarged density sensing region between the positions $P_3$ and $P'_4$ is substantially the same in length (in the scanning direction) as the document.

In the second mode operation, due to the enlarged density sensing region a latent image has already begun to be formed on the photoconductive element 34 when the inlet portion 56 of the optical fiber is brought to the position $P_4$. The second mode operation, therefore, includes a step of discarding such an image. First, the latent image is erased by an erase lamp, not shown, and a charger adapted for charge deposition is deactivated. If any part of the latent image is left non-erased, the developing bias $V_b$ is controlled to prevent it from being developed. In addition, the registration roller 40 is not rotated to hold the paper 38 which is fed out of a cassette in a standby condition.

Meanwhile, the scanner 20 which is sensing the document density is moved toward the home position after scanning the document over substantially the same dimension as the length of the document. Stated another way, in the second mode, a prescanning stroke is effected by interrupting the transition to a copying cycle. The signal $V_{de}$ derived from the prescanning stroke is loaded in the CPU 72 just before the scanner 20 is returned toward the home position. This is because when the scanner 20 scans a document in conformity to the size of the document, the imaging light 48 scans the document 12*b* or 12*c* down to the trailing end of the latter so that the sensing light 50, which precedes the imaging light 48, is advanced to the outside of the document 12*b* or 12*c* and cannot constitute density information.

In response to the detection signal $V_{de}$ produced by prescanning the density sensing section between the positions $P_3$ and $P'_4$ as stated above, the CPU 72 selects a particular image forming condition, i.e., it sets up a developing bias voltage $V_b$. It is to be recalled here that the developing bias $V_b$ is set up on the basis of the signal $V_{de}$ which is produced by prescanning a document over the enlarged density sensing region between $P_3$ and $P'_4$. Hence, assuming that the background density level $V_{de\gamma}$ of the background of the document 12*b* or 12*c* ranges from OD 0.05 to 0.3, the signal $V_{de}$ will rise beyond the reference level $V_{de\gamma}$ somewhere after the position $P_4$, as represented by the curve B in FIG. 6. This ensures detection of the background density of the document 12*b* or 12*c*. The scanner 20 returned to the home position performs a scanning stroke for imaging so that a copying cycle is effected under the particular imaging condition selected. At this instant, the paper 38 in the standby condition is driven by the registration roller 40.

As stated above, when sensing the density of a document in the density sensing region between the positions $P_3$ and $P_4$ in the first mode is insufficient, the first mode is replaced with the second mode so that the document density is sensed by prescanning the enlarged region between the positions $P_3$ and $P'_4$ so as to enter into a copying cycle after setting up an imaging condition. This prevents a copy derived from a document with a solid portion, for example, from appearing low in density. Most of various possible documents can be processed in the first mode without prescanning, resulting in an increase in copying rate.

In summary, it will be seen that the present invention provides a method which features a first mode, or basic mode, in which document density sensing is performed over a predetermined region and immediately followed by a copying cycle, and a second mode which is selected when a detection signal is short of a predetermined level so as to perform a different density sensing operation. Hence, ordinary documents are processed in the first mode without prescanning to enhance rapid copying operations, while documents which contain solid portions are processed in the second mode to provide adequate image density matching with the background density of such a document.

Various modifications will become possible for those skilled in the art after receiving the teachings of the present disclosure without departing from the scope thereof.

What is claimed is:

1. A method of automatically adjusting image density in an image forming device which controls an imaging condition on the basis of a density of a document, comprising the steps of:

(a) at a start of a copying operation, setting up a first mode in which a first document density is sensed by scanning a first predetermined region of said document and, then, said copying operation is continued while controlling said imaging condition based on said first document density;

(b) if said first document density sensed lies in a predetermined range of density levels, executing said first mode directly; and (c) if said first document density does not lie in said predetermined range of density levels, replacing said first mode with a second mode in which a second predetermined region of said document is scanned to produce a second document density and, then, performing a copying operation while controlling said imaging condition based on said second document density.

2. A method as claimed in claim 1, wherein said copying operation comprises forming a latent image, said step (c) comprising the step of (d) dicarding said latent image formed.

3. A method as claimed in claim 1, wherein said imaging condition to be controlled comprises a developing bias voltage.

4. A method as claimed in claim 1, wherein said imaging condition to be controlled comprises an amount of exposing light.

5. A method as claimed in claim 1, wherein said first predetermined region is a part of a size of said document which extends in a scanning direction.

6. A method as claimed in claim 5, wherein said second predetermined region extends over substantially the whole size of said document in the scanning direction.

* * * * *